US005430983A

United States Patent [19]

Taipalensuu

[11] Patent Number: 5,430,983

[45] Date of Patent: Jul. 11, 1995

[54] FITTING AND A METHOD FOR MOUNTING OF A TIMBER BUILDING

[76] Inventor: Börje Taipalensuu, Järnvägsgatan 27, 953 32 Haparanda, Sweden

[21] Appl. No.: 142,425

[22] PCT Filed: May 18, 1992

[86] PCT No.: PCT/SE92/00321

§ 371 Date: Nov. 22, 1993

§ 102(e) Date: Jan. 10, 1994

[87] PCT Pub. No.: WO92/20878

PCT Pub. Date: Nov. 26, 1992

[30] Foreign Application Priority Data

May 22, 1991 [SE] Sweden ..... 9101548

[51] Int. Cl.[6] ..... E04B 1/38

[52] U.S. Cl. ..... 52/233; 403/405.1; 52/562; 52/564; 52/570

[58] Field of Search ..... 52/561, 562, 564, 568, 52/569, 570, 571, 522, 233 OR; 403/405.1, 389

[56] References Cited

U.S. PATENT DOCUMENTS

| | | | |
|---|---|---|---|
| 2,365,397 | 12/1944 | Dickman | 52/233 |
| 3,910,709 | 10/1975 | Krekeler | 403/405 X |
| 3,964,227 | 6/1976 | Hala . | |
| 4,263,765 | 4/1981 | Maloney | 52/564 X |
| 4,343,566 | 8/1982 | Giovannetti | 403/405.1 |
| 4,517,780 | 5/1985 | Lacombe et al. | 52/562 X |
| 4,577,447 | 3/1986 | Doran | 52/570 X |
| 4,604,843 | 8/1986 | Ott et al. | 52/562 X |
| 4,698,947 | 10/1987 | McKay | 52/564 X |
| 4,777,773 | 10/1988 | Fry | 52/233 X |
| 4,823,528 | 4/1989 | Faw | 52/233 |
| 4,835,928 | 6/1989 | Scott | 52/564 X |
| 5,328,290 | 7/1994 | Plastina | 403/389 X |
| 5,361,556 | 11/1994 | Menchetti | 52/561 |

FOREIGN PATENT DOCUMENTS

| | | | |
|---|---|---|---|
| 3248739 | 6/1984 | Germany | 403/405 |
| 3408608 | 9/1986 | Germany . | |
| 402610 | 7/1978 | Sweden . | |
| 0623019 | 8/1978 | U.S.S.R. | 403/405 |
| 88/06215 | 8/1988 | WIPO . | |

*Primary Examiner*—Carl D. Friedman
*Assistant Examiner*—Wynn E. Wood
*Attorney, Agent, or Firm*—Burns, Doane, Swecker & Mathis

[57] ABSTRACT

A fitting is intended for mounting and joining horizontal tongue-and-grooved panels to form an inner wall and an outer wall respectively in a timber building structure. The fitting includes two parts which can be moved linearly in relation to one another in the directions of arrows A and B. Each of the two fitting-parts includes a flanged dowel which is intended for insertion into holes pre-drilled in respective inner and outer panels. The fitting also includes two upper dowels which are intended to be firmly screwed onto the lower dowels. Further inner and outer panels are mounted on the upper dowels with the aid of the pre-drilled holes. This building method results in two free-standing walls, i.e., the inner and outer walls respectively.

18 Claims, 5 Drawing Sheets

FITTING AND A METHOD FOR MOUNTING OF A TIMBER BUILDING

BACKGROUND OF THE INVENTION

The present invention relates to a fitting and to a method for erecting and joining together the inner and the outer walls of a timber building structure, said walls consisting of horizontal tongue-and-grooved boarding or panels.

Originally, timber buildings were constructed from corner-tied or dovetailed solid timber. One drawback with this method of construction resides in the large amount of wood consumed and, because wood is a relatively poor insulating material (wood has a low k-value), also in poor insulation of the building.

One method of solving the problem of insulation is to nail battens onto the inner surface of the corner-tied solid or whole timber and to pack mineral wool between the battens, therewith insulating the structure in a conventional manner. A diffusion barrier and internal panels are then secured to the battens.

Another method of constructing insulated timber buildings is to nail wooden panels onto a so-called stud structure, both internally and externally, and pack mineral-wool insulation in the cavity between the panels or boarding. So that the building will resemble a genuine log building, artificial corner-ties are attached to the building when practicing this method.

Another method of constructing insulated timber buildings involves screwing internal wooden panels onto studwork with the aid of some kind of angular fitting. The space or cavity between the inner panels and the outer wall is then insulated with mineral wool. These known methods of constructing insulated timber buildings have the drawbacks of requiring the provision of studwork, i.e. horizontal and vertical support members, and that nailing of the panels takes a relatively long time to complete and results in the generation of stresses as a result of differences in expansion of the inner and the outer walls, due to differences in outdoor and indoor humidities.

SUMMARY

The aforesaid problems are solved with the use of the inventive fitting when erecting and joining the inner and the outer walls respectively of a timber building structure, said walls comprising horizontal, tongue-and-grooved panels or boards. The internal and external tongue-and-grooved "timber panels" forming the walls are joined together with the aid of the inventive fitting in a manner to leave a gap between the inner and the outer wall. This gap, or cavity, between the inner and the outer panels is then insulated with the aid of an appropriate insulating material, for instance cellulose fibre. Because the fitting comprises two parts which are able to slide vertically in relation to one another when the fitting is fitted to a wall, two free-standing walls are obtained, i.e. the inner and the outer walls respectively are able to expand transversely to the fibre direction of the wood, independently of one another. This is achieved with the aid of a fitting having the characteristic features set forth in Claim 1, and by means of the method defined in Claim 9.

BRIEF DESCRIPTION OF THE DRAWINGS

The inventive fitting will now be described in more detail with reference to the accompanying drawings, in which.

DETAILED DESCRIPTION OF PREFERRED EMBODIMENTS

Figure 1:
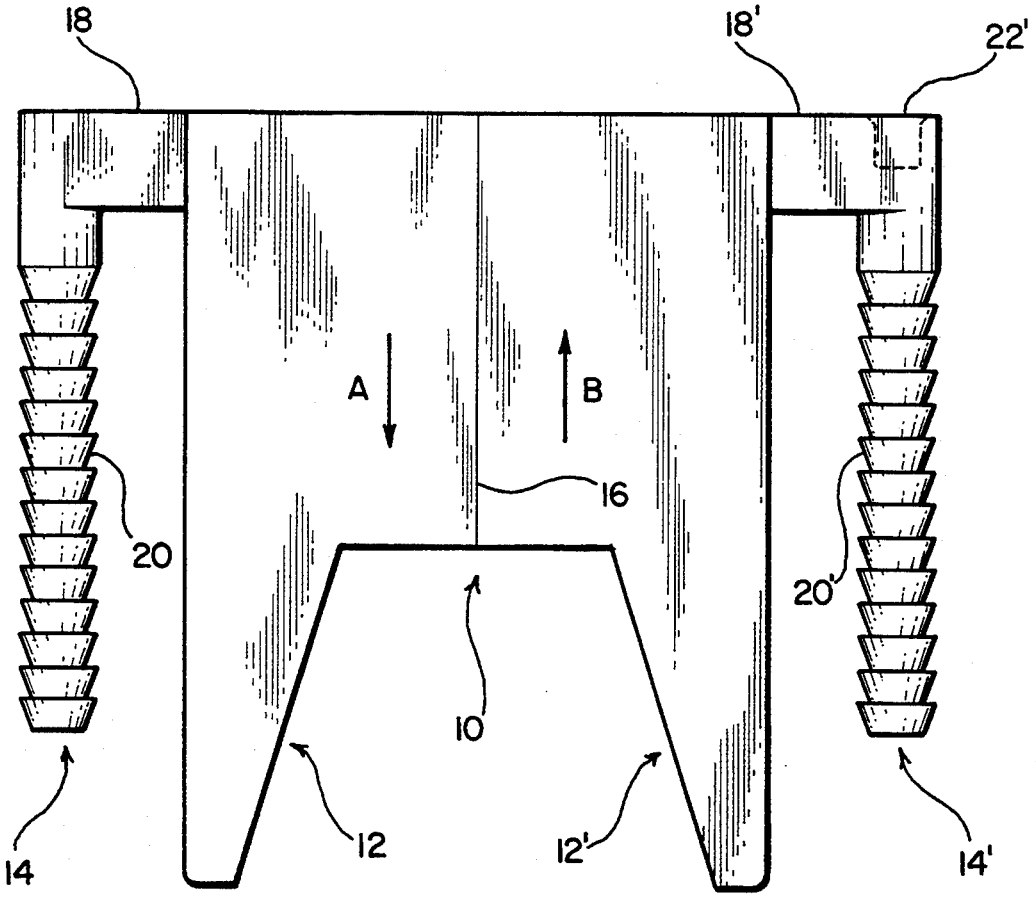
FIG. 1 is a side view of a first embodiment of the inventive fitting.

FIG. 1 is a side view of a first embodiment of the inventive fitting, here referenced 10. The fitting 10 is comprised generally of two parts 12, 12 which are slidable in relation to one another along the line 16, in the directions shown by arrows A and B. Each of the two parts 12, 12' includes a respective dowel 14, 14' which are intended to be fitted into holes pre-drilled in respective inner and outer panels, as described in more detail hereinafter. The dowels 14, 14' are connected to the fitting-parts 12, 12' by connecting means 18, 18'. The dowels or attachment device 14, 14' are provided externally with collar-like projections 20, 20' which function to affix respective dowels 14, 14' in the pre-drilled hole in the panel, thereby also fixating the fitting 10. The dowels 14, 14' are cylindrical and have an internal cavity which is intended to house a spring and a bolt (not shown in FIG. 1). Provided at the bottom of the dowel 14, 14' is a spring-retaining edge and an opening through which the spring-loaded bolt can pass. The dowels 14, 14' each have an upper internal screw thread (indicated at 22'), into which an externally screw-threaded upper dowel (not shown in FIG. 1) can be screwed and is intended to be screwed. The upper dowels are not provided with collars and are each provided with an upper internal screw thread into which the bolts of fittings placed above said dowels can be screwed.

Figure 2:
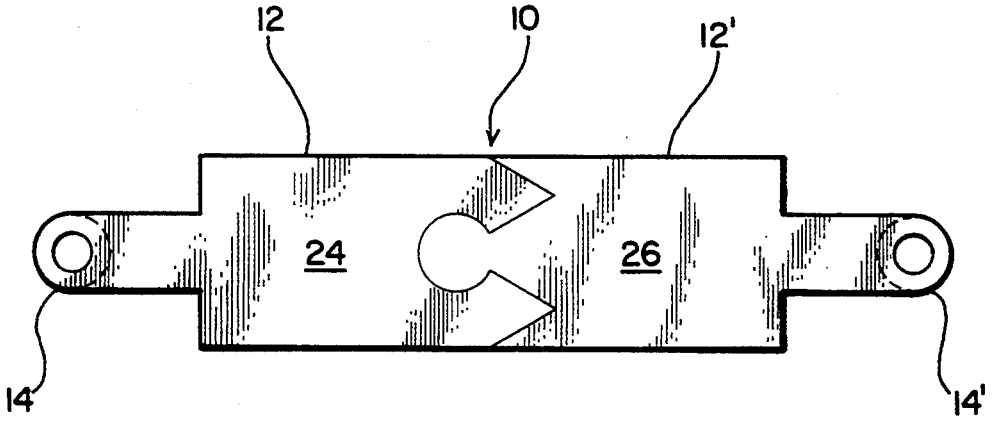
FIG. 2 is a top view of the fitting shown in FIG. 1.

FIG. 2 is a top view of the fitting 10 illustrated in FIG. 1. The reference signs used in FIG. 2 correspond to those used in FIG. 1 for equivalent parts. FIG. 2 shows clearly that the fitting-parts 12, 12' can slide in relation to one another. This sliding action of the parts 12, 12' is achieved due to the particular configuration of the mutually facing sides of said parts. In the FIG. 2 embodiment, the part 12 has a so-called "female type" cross-sectional shape on the side facing the part 12', while the part 12' has on the side thereof facing towards the part 12 a so-called "male type" cross-sectional shape. These female and male cross-sectional shapes are configured so that the fitting-parts 12, 12' will fit "exactly" into one another in the manner shown in FIG. 2. Thus, the parts 12, 12' are not relatively displaceable in the direction of the plane of the drawing but are slidable in relation to one another in those directions that are perpendicular to the plane of said drawing. It will be understood that the female and male cross-sections of respective parts 12, 12' may have configurations other than those shown in FIG. 2, provided that these configurations will satisfy the aforesaid requirement.

Figure 3:
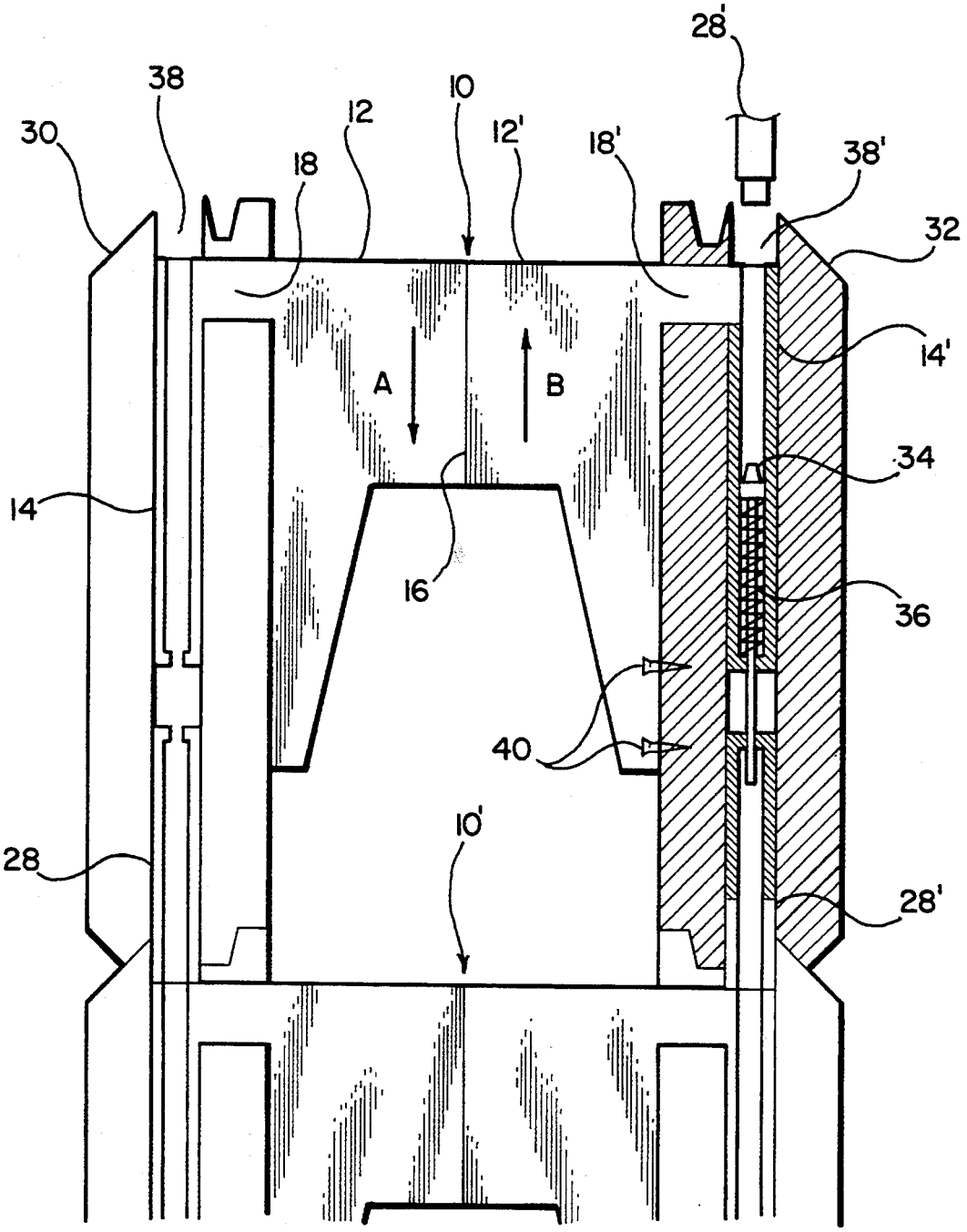
FIG. 3 is a cross-sectional view of the fitting shown in FIG. 1 when the fitting is mounted.
Figure 4:
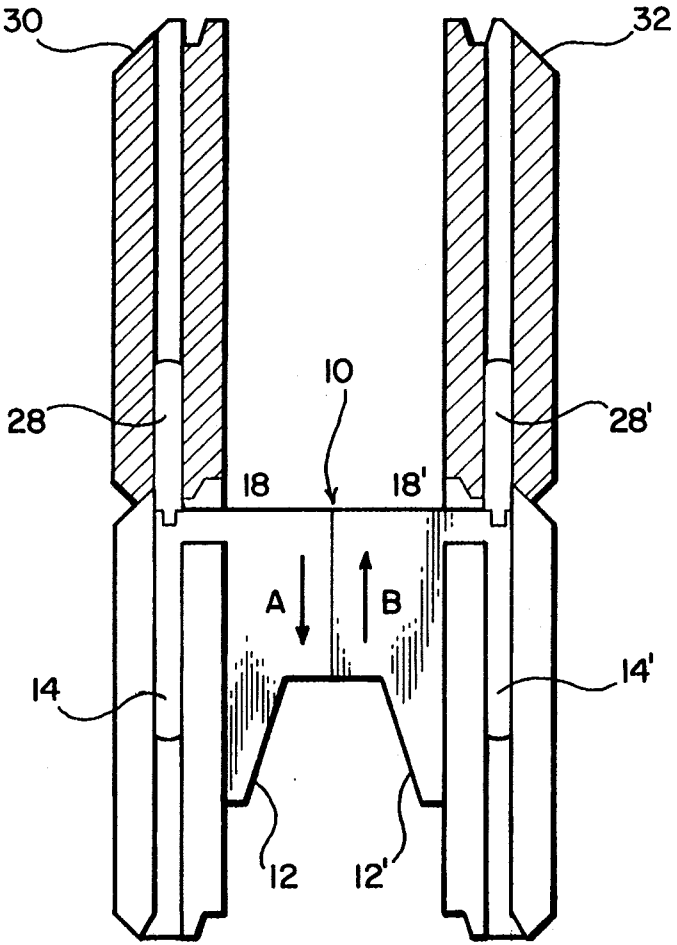
FIG. 4 is a cross-sectional view of a "timber wall" which is secured with the aid of the fitting shown in FIG. 1.

FIGS. 3 and 4 illustrate the manner in which the fitting 10 shown in FIGS. 1 and 2 is used to join two free-standing panels to "timber" in the construction of a timber building. FIG. 3 is a cross-sectional view of the fitting shown in FIG. 1 when mounted in position, and FIG. 4 is a cross-sectional view of a "timber wall" which is held joined together with the aid of the inventive fitting. FIGS. 3 and 4 show the fitting 10 fitted to a wall which comprises tongue-and-grooved inner panels 30 and outer panels 32. The panels 30, 32 have pre-drilled holes 38, 38' into which the dowels 14, 14' connected firmly to the parts 12, 12' are first inserted and fixated through the medium of the collars or like projections on the dowels 14, 14' (see FIG. 1). Fastening of the fitting 10 in the panels 30, 32 can be made stronger, by screwing screws 40 firmly into pre-drilled holes in the panels 30, 32. With the fitting 10 thus fitted, a gap or cavity is defined between the inner panel 30 and the outer panel 32. Because the two parts 12, 12' of the fitting 10 can slide relative to one another in the directions of arrows A, B, the panels 30, 32 are free-standing. After fitting the fitting 10 in the aforedescribed manner, two upper dowels or joining devices 28, 28' are screwed to the upper part of the lower dowels 14, 14', whereafter a further inner panel 30 and a further outer panel 32 are fitted onto the upper dowels 28, 28', so that the tongues and grooves of respective inner panels 30 and outer panels 32 fit one in the other (see FIG. 4). A further fitting 10 is then fitted, in the aforesaid manner, to the newly applied inner and outer panels 30, 32 respectively. A spring 36 and a bolt 34 are then inserted in each lower dowel 14, 14' in the fitting 10 last applied, whereafter the spring-loaded bolts 34 are tightened to an appropriate torque in the upper dowels 28, 28' of the underlying fitting 10' (see FIG. 3). By continuing to fit inner and outer panels in the aforesaid manner with the aid of inventive fittings 10, it is possible to construct a "timber building" which comprises two free-standing walls, i.e. inner and outer walls respectively, which are able to expand transversely to the fibre direction of the wood independently of one another. In the case of this construction, the inner wall is the load-bearing part of the structure and the outer wall can be permitted to expand to no disadvantage. This eliminates the problem caused by those stresses which occur in the walls of a permanently occupied building, in which the inner wall remains practically constant and does not vary, whereas the outer wall is able to expand by as much as 30–40 mm at the top of a wall of normal height, depending on the humidity of the air, etc. The space between the inner and the outer wall is then filled with a suitable insulating material, such as cellulose fibres, for instance. The cellulose fibre may suitably be injected into the wall cavity. This provides better insulation (k-value) than solid timber (about a threefold improvement on solid wood of corresponding dimensions).

Figure 5:
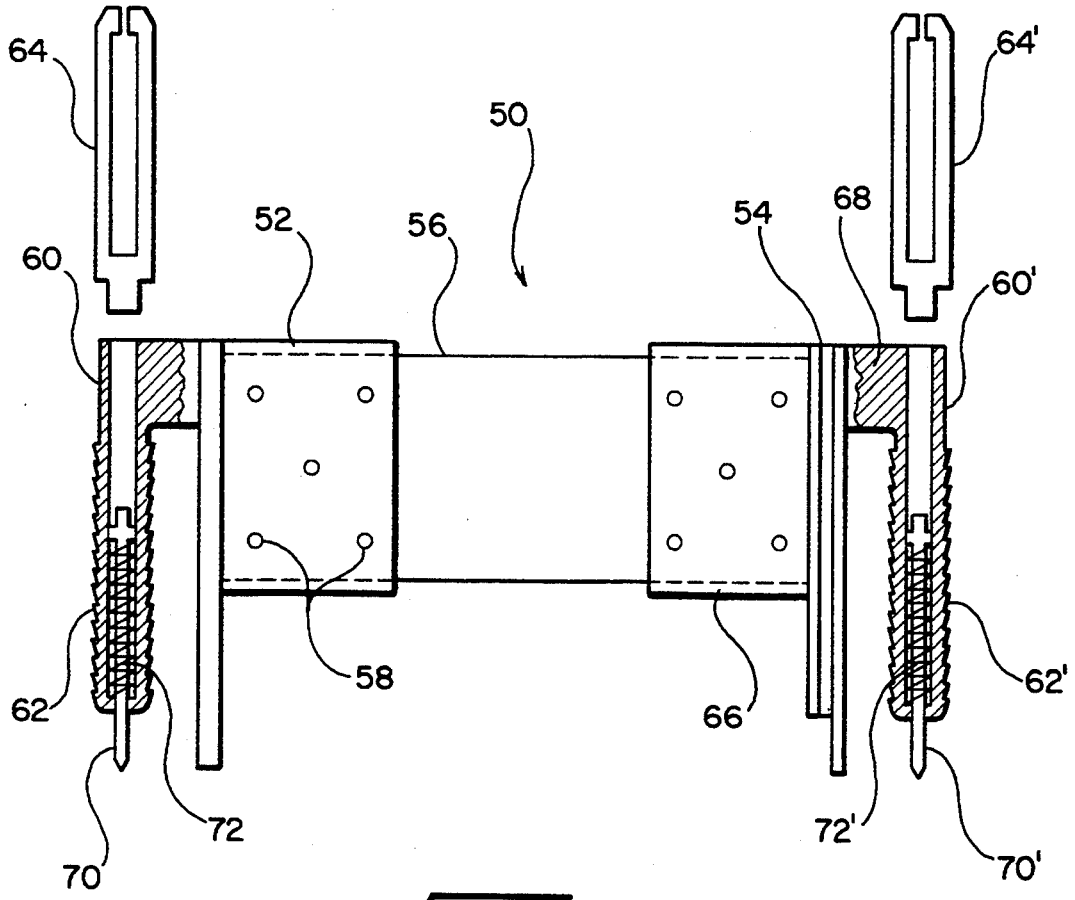
FIG. 5 is a side view (partial cross-sectional view) of another embodiment of the inventive fitting.
Figure 6:
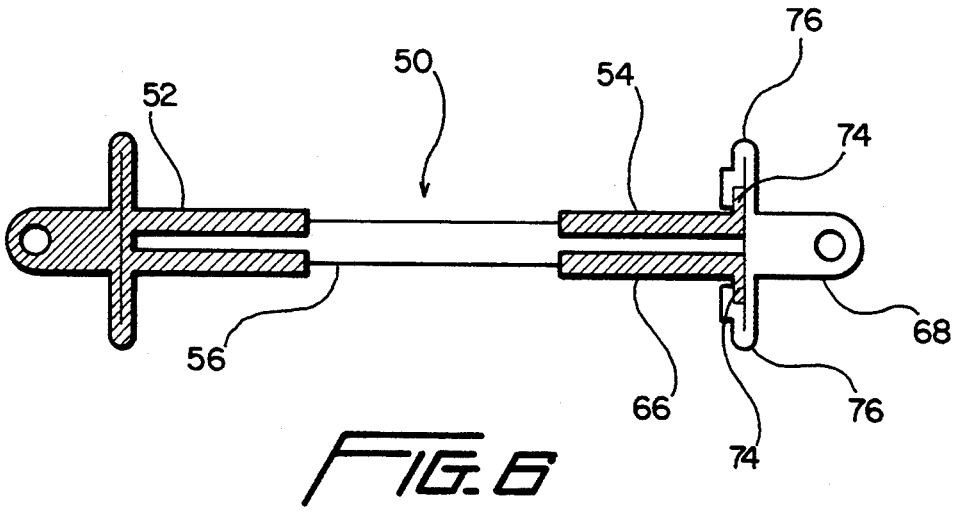
FIG. 6 is a top view of the fitting illustrated in FIG. 5.

FIG. 5 is a side view (partially in cross-section) of a second embodiment of the inventive fitting. The fitting 50 is comprised generally of a "fixed" part 52 and a part 54 having a sliding function, these parts being mutually connected by a link part 56 which may be made of plywood for instance. The link part 56 is inserted into grooves provided in the two parts 52, 54 to this end (c.f. FIG. 6) and is secured with the aid of a number fastener means 58, with the aid of clenches for instance. Each of the two parts 52, 54 has a respective bottom dowel 60, 60' which is intended to be fitted into pre-drilled holes in respective inner and outer panels, similar to the manner described with reference to the fitting illustrated in FIGS. 1–4. Each of the bottom dowels 60, 60' also has outwardly extending collar-like projections 62, 62' which function in the same way as the collar-like projections 20, 20' on the fitting 10. The fitting 50 also includes two top dowels 64, 64' which are intended to be screwed onto the bottom dowel 60, 60'. The bolts 70, 70' and the springs 72, 72' have the same function as the bolts and springs illustrated in FIG. 3. The main difference between the fitting 50 and the fitting 10 resides in the sliding function of the part 54 of said fitting 50 and also in that the length of the fitting which determines the depth of the cavity obtained between respective inner and outer panels can be adjusted by using link parts 56 of mutually different lengths. This enables any desired thickness of insulation to be used. The part 54 providing the sliding function includes two parts 66, 68 which can be moved linearly in relation to one another. FIG. 6 is a top view of the fitting shown in FIG. 5 and clearly illustrates how the aforesaid sliding function is achieved. Thus, the part 54 providing said sliding function includes the two parts 66 and 68 which can be moved axially in relation to one another. The part 66 includes two right-angled projections 74 at one end thereof, while the part 68 includes two internally-grooved right-angled projections 76. The grooves in the projections 76 are configured so that the projections 74 will fit thereinto in a manner such as to enable the part 66 and the part 68 to slide relative to one another in the vertical direction when the fitting is mounted in position, and are fixed relative to one another in the horizontal direction. In other respects, the fitting 50 is mounted, used and functions in a manner corresponding to the fitting 10 described in the aforegoing.

Figure 7:
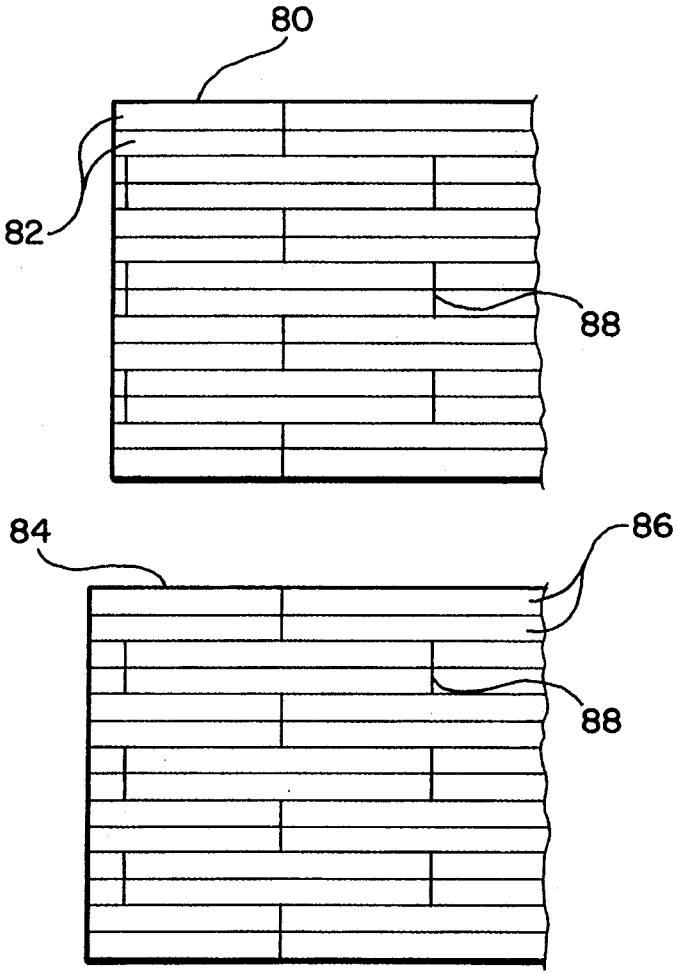
FIG. 7 illustrates the position at which the inventive fitting is fitted to a wall with spring-loading so that a load or force will act continuously in the wall independently of any external load.

FIG. 7 illustrates a wall structure to which the fitting has been mounted with spring-loading, so that a load will constantly act in the wall structure independently of any external load. In FIG. 7, the reference numeral 80 identifies an inner wall consisting of inner panels 82, while reference numeral 84 identifies an outer wall consisting of outer panels 86, said outer panels 86 and said inner panels 82 being joined together with the aid of fittings constructed in accordance with the invention. The reference numeral 88 identifies a fitting mounted in position under a spring load. Fittings which are not spring-loaded, i.e. fittings which lack the aforesaid bolts and springs, are mounted between the aforesaid spring-loaded fittings. As will be seen from the Figure, the fittings are positioned laterally at a suitable, predetermined distance apart. Furthermore, the spring-loaded fittings are mounted in the manner shown in FIG. 7, i.e. "alternately", so that a load will act continuously in the wall is loaded independently of any outer load.

Figure 8:
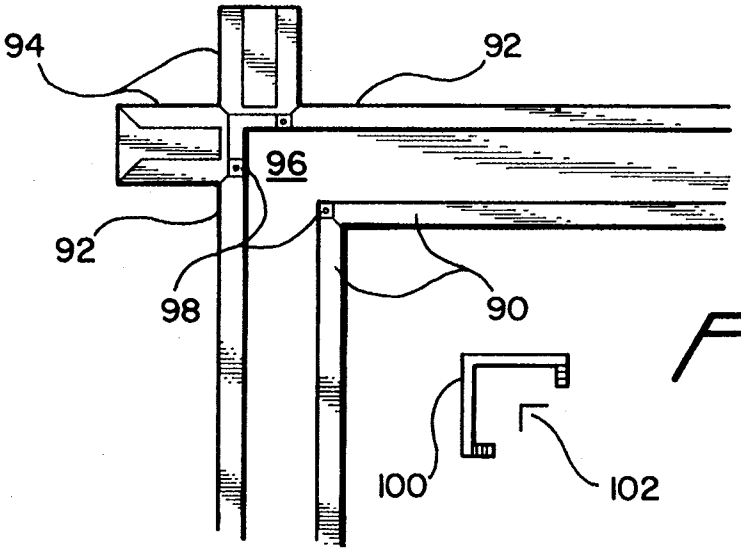
FIG. 8 is a cross-sectional view of walls to which corner-ties have been attached with the aid of the inventive fitting.
Figure 9:
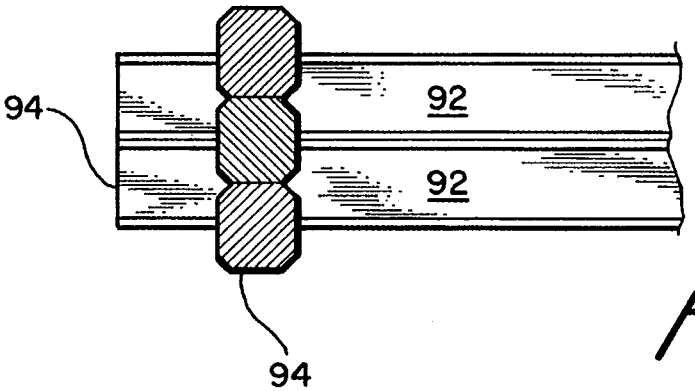
FIG. 9 is an external side-view of the corner-tie shown in FIG. 8.

FIG. 8 is a cross-sectional view of walls provided with corner-ties or braces and erected or constructed with the aid of inventive fittings. As will be seen from FIG. 8, the width of the outer corner-ties 94 need not correspond to the width of the wall, but can simply be adapted to the height of the panel so as to obtain the correct height/width proportions irrespective of the spacing between the inner panel 90 and the outer panel 92. In addition, the corner-ties may be made totally draught-free, since the "corner" 96 can be insulated with cellulose fibre. The illustrated corner-ties can be produced by using in the inner corner a covering strip 102, a locking band 100 and a dowel 98 and by using dowels 98 in the outer corner. For appearances sake, the outer corner-tie 94 may be glued to a "block", so as to give the appearance that solid timber has been used. FIG. 9 is an external side view of the corner-tie shown in FIG. 8.

Figure 10:
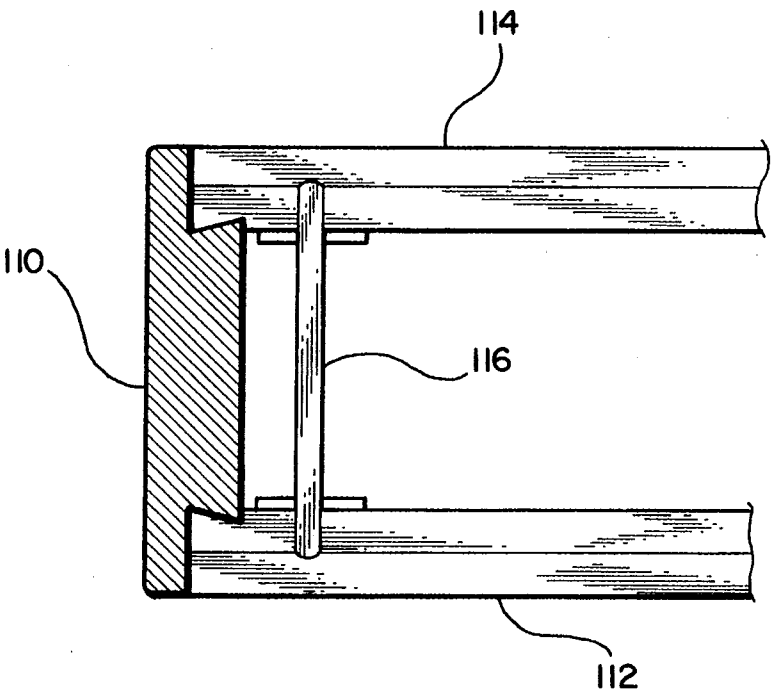
FIG. 10 illustrates a slide strip for the windows and door openings of a building constructed with the aid of the inventive fitting.

FIG. 10 illustrates a slide strip for windows and door openings of a building that has been erected or constructed while using fittings according to the present invention. The slide strip 110 is used on window and door openings for attachment of the window and door frames and to obscure the gap occurring between inner panel 112 and outer panel 114 when these panels are mounted with the fitting 116 according to the present invention.

Other advantages obtained when using the inventive fitting include a technically simple production line, improved ease of handling, the fittings can be mounted on site, therewith greatly reducing freight volume/cost, particularly in the case of long transportation distances, markedly shortened production time in comparison with conventional solid timber constructions and supplementary insulation of such constructions, and cheaper production due to reduced wood consumption. Given below is an example of the wood consumed calculated on 1,000 lm wood in comparison with corresponding dimensions of solid timber.

Planed wood 45×170 mm, cavity depth 120 mm, about 23 cbm less wood

Round timber $\phi$ 300 mm, cavity depth 120 mm, about 34 cbm less wood

Round timber $\phi$ 400 mm, cavity depth 200 mm, about 74 cbm less wood

These calculations, show that wood consumption is reduced by more than half with the cavity depths and wood dimensions stated. Furthermore, the small k-values obtained are about three times better than the corresponding values obtained with solid timber of corresponding dimensions. The inventive fitting and the inventive method can also be used with round timber panels, even though this has not been shown in the drawings.

The aforedescribed and illustrated embodiments are merely examples of how the invention can be realized and are in no way limited of the invention, the protective scope of which is defined in the following Claims.

I claim:

1. A fitting for mounting and joining together inner and outer walls respectively, comprising:

a first part and a second part which are mutually joined to one another;

a first attachment device mounted on the first part for attachment of the first part to a first inner panel of the inner wall and a second attachment device mounted on the second part for attachment of the second part to a first outer panel of the outer wall;

a first joining device which is insertable in a second inner panel of the inner wall and is attachable to said fitting for joining together the first inner panel and the second inner panel;

a second joining device which is insertable in a second outer panel of the outer wall and is attachable to said fitting for joining together the first outer panel and the second outer panel;

whereby a complete inner wall and a complete outer wall can be obtained respectively by using several fittings to connect a plurality of panels;

said fitting defining a cavity between the inner wall and the outer wall into which insulating material can be introduced; and the first fitting-part and the second fitting-part are vertically slidable in relation to one another for eliminating stresses originating from differences in the expansion of the inner and the outer wall.

2. A fitting according to claim 1, wherein each attachment device is comprised generally of a cylindrical device for insertion into respective holes that are pre-drilled in the panels.

3. A fitting according to claim 2, wherein each attachment device is comprised of a first dowel having extending around a periphery thereof a plurality of projections which function to fixate the dowel in one of the pre-drilled holes in the panels; and each of the joining devices is comprised of a second dowel which lacks a provision of such projections; the second dowel and the first dowel can be joined with a screw joint in a manner such that the first dowel subsequent to its fixation will be located in a pre-drilled hole in a lower panel and the second dowel will be essentially located in a pre-drilled hole in a panel which has been placed on top of the lower panel with the aid of a tongue-and-grooved joint.

4. A fitting according to claim 3, wherein the first dowel is provided at its bottom end with a hole whose diameter is smaller than a diameter of the first dowel; the second dowel is provided at its upper end with an internally screw-threaded hole which enables two fittings to be joined together by insertion of a spring-loaded bolt in the first dowel of a fitting, so that a screw-threaded part of the bolt will protrude partially from the hole of the first dowel and a screw thread joint is obtained with the second dowel of another fitting.

5. A fitting according to claim 4, wherein the first part and the second part have mutually facing side surfaces; the side surface of the first part has a male-type cross-sectional shape and the side surface of the second part has a female-type cross-sectional shape, such that the cross-sectional shapes fit tightly together in a manner which enables the first part and the second part to slide vertically in relation to one another but to be fixed in relation to one another in a horizontal direction.

6. A fitting according to claim 4, wherein the fitting also includes a link part for connection between the first part and the second part, wherein the link part is inserted in a respective groove in the first part and the second part and is fixed by connecting means and the second part includes two mutually abutting parts which are slidable vertically in relation to one another.

7. A fitting according to claim 6, wherein the connecting means comprise clench joints; and one of said first and second parts includes two projections which extend perpendicularly to the main extension of said one part; and the other of said first and second parts includes two grooved projections, wherein the configuration of the grooves is such that the projections on the first part fit into said grooves so as to enable said first part to slide in relation to the second part in the vertical direction but to remain fixed in relation to said second part in the horizontal direction.

8. A fitting according to claim 7, wherein the link part is replaceable so as to enable a length of the fitting to be adjusted and therewith the distance between the inner wall and the outer wall.

9. A method for erecting and securing inner and outer walls, comprising the steps of:

a) joining an inner panel and an outer panel with a first fitting which includes a first fitting-part and a second fitting-part which are mutually joined and are able to slide in relation to one another and each of which includes an attachment device, by fastening with the aid of the attachment devices the first fitting-part and the second fitting-part to the inner panel and the outer panel respectively such that the fitting will define a distance between said inner panel and said outer panel;

b) fastening a joining device forming part of the fitting in an upper part of each of the attachment devices;

c) with the aid of tongues, grooves and said joining devices mounting a further inner panel and a further outer panel on top of the aforesaid inner panel and the aforesaid outer panel;

d) repeating step a) on said further inner panel and said further outer panel with a second fitting;

e) joining the attachment devices in said second fitting with the joining devices in the first fitting with spring-loaded bolts; and f) repeating steps d) and e) so as to obtain an inner-wall and an outer-wall structure respectively which define said spacing therebetween and which are vertically slidable in relation to one another to eliminate stresses originating from differences in expansion of the inner and the outer wall structures.

10. A method according to claim 9, wherein step a) includes inserting each attachment device into a respective pre-drilled hole in the inner panel and the outer panel respectively, said attachment device comprising a first dowel having a number of outwardly extending projections arranged peripherally around said dowel; and said step d) includes screwing a bottom part of the joining device firmly into an upper part of a respective first dowel, said joining device comprising a second dowel which lacks peripheral projections.

11. A method according to claim 10, wherein the pre-drilled holes in the further inner panel and the further outer panel respectively are fitted onto the second dowels and that tongues and grooves are fitted into one another; and step e) includes the insertion of spring-loaded bolts in the first dowels included in the further second fitting and securing the spring-loaded bolts in a screw-threaded part of the upper part of each said second dowel so as to join the first fitting to the further second fitting.

12. A method according to claim 11, wherein corner ties are provided at a point where two mutually perpendicular walls meet, by applying in a corner between two inner panels a covering strip, a locking band and a dowel and by applying in a corner between two outer panels two dowels and by applying filling material to the thus obtained external corner ties so as to give the appearance of solid timber.

13. A fitting according to claim 1, wherein said panels are horizontal tongue and grooved panels.

14. A method according to claim 9, wherein said panels are horizontal tongue and grooved panels.

15. A fitting according to claim 8, wherein said panels are horizontal tongue and grooved panels.

16. A method according to claim 12, wherein said panels are horizontal tongue and grooved panels.

17. A method according to claim 9, further comprising the step of insulating the space defined between the inner wall and the outer wall with a suitable material.

18. A method according to claim 17, wherein the suitable material is cellulose fibre.

* * * * *